US009687133B2

(12) United States Patent
Zhu et al.

(10) Patent No.: US 9,687,133 B2
(45) Date of Patent: Jun. 27, 2017

(54) PRESSING SPRAY MOP

(71) Applicant: Jiaxing Jackson Travel Products Co., Ltd., Jiaxing (CN)

(72) Inventors: Xue Lin Zhu, Jiaxing (CN); Jing Li, Jiaxing (CN)

(73) Assignee: JIAXING JACKSON TRAVEL PRODUCTS CO., LTD., Jiaxing, Zhejiang (CN)

( * ) Notice: Subject to any disclaimer, the term of this patent is extended or adjusted under 35 U.S.C. 154(b) by 15 days.

(21) Appl. No.: 15/009,205

(22) Filed: Jan. 28, 2016

(65) Prior Publication Data

US 2016/0345794 A1 Dec. 1, 2016

(30) Foreign Application Priority Data

Jun. 1, 2015 (CN) ..... 2015 2 0366241 U

(51) Int. Cl.
*A47L 13/22* (2006.01)
*A47L 13/42* (2006.01)

(52) U.S. Cl.
CPC ..... *A47L 13/22* (2013.01); *A47L 13/42* (2013.01)

(58) Field of Classification Search
CPC ..... A47L 13/22
USPC ..... 401/136, 137, 138, 139, 148, 188 R
See application file for complete search history.

(56) References Cited

U.S. PATENT DOCUMENTS

| | | | |
|---|---|---|---|
| 6,579,023 | B2 | 6/2003 | Kunkler et al. |
| 7,048,804 | B2 | 5/2006 | Kisela et al. |
| 8,844,088 | B2 | 9/2014 | Garcia Castillo |
| 9,173,540 | B2 | 11/2015 | Scolari |

FOREIGN PATENT DOCUMENTS

| | | | |
|---|---|---|---|
| CN | 203244350 | U | 10/2013 |
| CN | 204207689 | U | 3/2015 |
| CN | 204246077 | U | 4/2015 |
| TW | 586407 | U | 5/2004 |

*Primary Examiner* — David Walczak
*Assistant Examiner* — Joshua Wiljanen
(74) *Attorney, Agent, or Firm* — Muncy, Geissler, Olds & Lowe, P.C.

(57) ABSTRACT

A pressing spray mop includes a mop rod, a mop head, a water tank seat, a spray mechanism installed at the water tank seat, and a water tank installed on the water tank seat. The water tank seat includes a hollow housing, and two support half casings encapsulating the spray mechanism after having been joggled and placed in the hollow housing, and forming a movement space corresponding to a water drawing member of the spray mechanism. The hollow housing includes a through connecting hole disposed correspondingly to the movement space. The mop rod includes a rod body, a penetration opening disposed on the rod body, and a pressing pin extended into the movement space via the through connecting hole. The pressing pin is driven and displaced by the mop rod in the movement space and presses the water drawing member to cause the spray mechanism to perform spraying.

11 Claims, 7 Drawing Sheets

PRESSING SPRAY MOP

FIELD OF THE INVENTION

The present invention relates to a mop, and particularly to a pressing spray mop.

BACKGROUND OF THE INVENTION

In current common or commercially available spray mops, water spray is primarily triggered by a lever, as disclosed in the U.S. Pat. Nos. 7,048,804, 9,173,540, 8,844,088 and 6,579,023. In the above technical solutions of triggering water spray by a lever, the lever primarily serving as a trigger source is disposed on a handle of the spray mop. Thus, manufacturers need to dispose a connecting line along a mop rod of the spray mop, and a pump structure on the spray mop is then activated by the connecting line to perform water spray. However, due to factors such as long-term use or unsatisfactory assembly, the connecting line may become malfunctioning such that the spray mop fails to perform spraying. Further, also because of the connecting line disposed, maintenance is made more inconvenient. In addition, to ensure that the connecting line is reliably triggered by the lever, the mop rod of the spray mop implemented by the above technical solution cannot be adjusted in length according to actual requirements, hence disfavoring its application.

In view of the above, some manufacturers have improved the technical structure of the foregoing spray mop to provide an application of water spray achieved by downwardly pressing a mop rod, e.g., as disclosed in the Taiwan Patent No. 586,407, and the China Patent Nos. 204207689, 204246077 and 203244350. Among the above, the China Patent No. 204246077 discloses a spray mop including a mop rod and a spray mechanism. The spray mechanism includes a water pump and a bottle seat. The water pump is installed in the water seat. The mop rod is vertically slidably connected to the water seat, and is connected to a piston of the water pump. When the spray mop enters a spray state, the mop rod is perpendicular to the ground, and the piston of the water pump is driven when the mop rod moves in the bottle seat to cause the water pump to spray water. Further, the China Patent No. 203244350 discloses an improved spray mop. The spray mop includes a pressing rod, a mop rod, a water storage bottle, a housing and a mop head. The mop rod is connected to a mop rod connector of the housing. The housing includes a pressure pump and a water storage bottle connector disposed in a fixed form. The pressure pump includes an entrance connected to a water entrance connector, and a piston rod connected to a water exit connector. The water storage bottle is fixedly connected to the water bottle connector, and is connected to the water entrance connector via a water entering pipe. The water exit connector is connected to a nozzle fixed on the housing via a water exiting pipe. The pressing rod is movably disposed on the mop rod connector and abuts upon the water exit connector. The pressing rod and the piston rod of the pressure pump are located on the same axial line.

In the above technical solution disclosing the spray mop that implements water spray by pressing the mop rod, associated elements that the spray mop adopts to implement water spray need to be assembled through external components such as screw elements or riveting elements. Thus, an installation process for involving these external components is increased to lead to an increase in labor hours. Further, during the assembly process involving the external components, an issue of poor assembly may occur, such that the components may become loose and connecting points of the components may even be damaged in more severe cases, hence disfavoring mass production or user applications.

SUMMARY OF THE INVENTION

The primary object of the present invention is to solve issues of a conventional mop spray having increased labor hours and poor assembly caused by the assembly involving external components.

To achieve the above object, the present invention provides a pressing mop spray. The pressing mop spray includes a mop rod, a mop head disposed at one end the mop rod, a water tank seat disposed at the mop rod, a spray mechanism installed at the water tank seat, and a water tank installed on the water tank seat and storing a cleaning liquid. The spray mechanism includes a water drawing member, a connecting pipe assembly connected to the water drawing member and the water tank, and a spray member connected to the water drawing member. The water tank seat includes a hollow housing, and two support half casings encapsulating the spray mechanism and mutually joggled and placed in the hollow housing. The two assembled support half casings form a movement space for disposing the water drawing member of the spray mechanism. The hollow housing includes a through connecting hole correspondingly disposed to the movement space. The mop rod includes a rod body to be accommodated by the water tank seat, a penetration opening disposed on the rod body, a pressing pin provided at the penetration opening and extended into the movement space via the through connecting hole. The pressing pin is driven by the mop rod to move in the movement space and presses the water drawing member to cause the spray mechanism to perform spraying.

In one embodiment, one of the two support half casings includes at least one tenon facing the other support half casing, and the other of the two support half casings not provided with the tenon includes at least one mortise corresponding to each tenon.

In one embodiment, each of the support half casings includes an accommodating chamber for accommodating the spray mechanism, and each of the accommodating chambers includes at least one first accommodating portion for disposing the water drawing member and a second accommodating portion for disposing the connecting tube assembly.

In one embodiment, each of the support half casings includes a recessed portion connected to the accommodating chamber, and the two recessed portions form the movement space after the two support half casings are mutually joggled.

In one embodiment, the pressing pin includes at least one inverted hook, which limits and prohibits the pressing pin from disengaging from the mop rod.

In one embodiment, the hollow housing includes a plurality of installation ribs each abutting against at least one of the support half casings.

In one embodiment, the water tank seat includes a sealing cover installed in the hollow housing to limit the two support half casings.

In one embodiment, the sealing cover includes at least one connecting piece disposed along an inner wall of the hollow housing. Each of the connecting pieces includes a fastening stopping portion protruding towards a direction of the hollow housing, and the hollow housing includes a limiting hole forming a fastening relationship with the fastening stopping portion.

In one embodiment, the pressing spray mop includes a mobile connecting mechanism connected to the mop rod and the mop head. The mobile connecting mechanism has a locked state and a utilization state. In the locked state, the mop rod is placed levelly on the mop head and prohibits the mop rod from pressing downwards. In the utilization state, the mop rod is at an inclined angle relative to the mop head to allow the mop rod to be pressed downwards. Further, the inclined angle is 90 degrees.

In one embodiment, the mobile connecting mechanism includes a connecting seat provided on the mop head, a connecting member provided on the mop rod, and an inserting member. The connecting seat includes a connecting pole forming a penetration hole at the inclined angle, and a connecting sleeve assembled on the connecting pole and capable of rotating multi-directionally. The connecting sleeve includes two correspondingly disposed installation holes. The connecting member includes a trigger head portion facing the connecting pole and a hollow portion. The inserting member fixedly fastens the two installation holes and is inserted into the hollow portion. When the mobile connecting mechanism is in the utilization state, the inserting member is capable of moving linearly in the hollow portion, such that the trigger head portion of the connecting member is extended into the penetration hole to allow the mop rod to be pressed downwards. When the mobile connecting mechanism is in the locked state, the trigger head portion of the connecting member is abutted against the connecting pole to prohibit the mop rod from being pressed downwards.

With the above technical solution, the present invention provides following features compared to the prior art. In the present invention, the assembly of the water tank seat and the mop rod can be accomplished without involving external components. Further, the stability of the assembled water tank seat and mop rod is substantial to the stability of an assembly completed with the use of external components. Further, as the assembly of structures of the present invention does not involve external components, the issue of loosening among the structures can further be prevented while the user operates the pressing spray mop. In addition, with the angle between the mop rod and the mop head, the mobile connecting mechanism may enter the utilization state or the locked state, so as to prevent an unintentional user touch from pressing the spray mop for spraying.

DETAILED DESCRIPTION OF THE PREFERRED EMBODIMENTS

Details and technical contents of the present invention are given with the accompanying drawings below.

Figure 1:
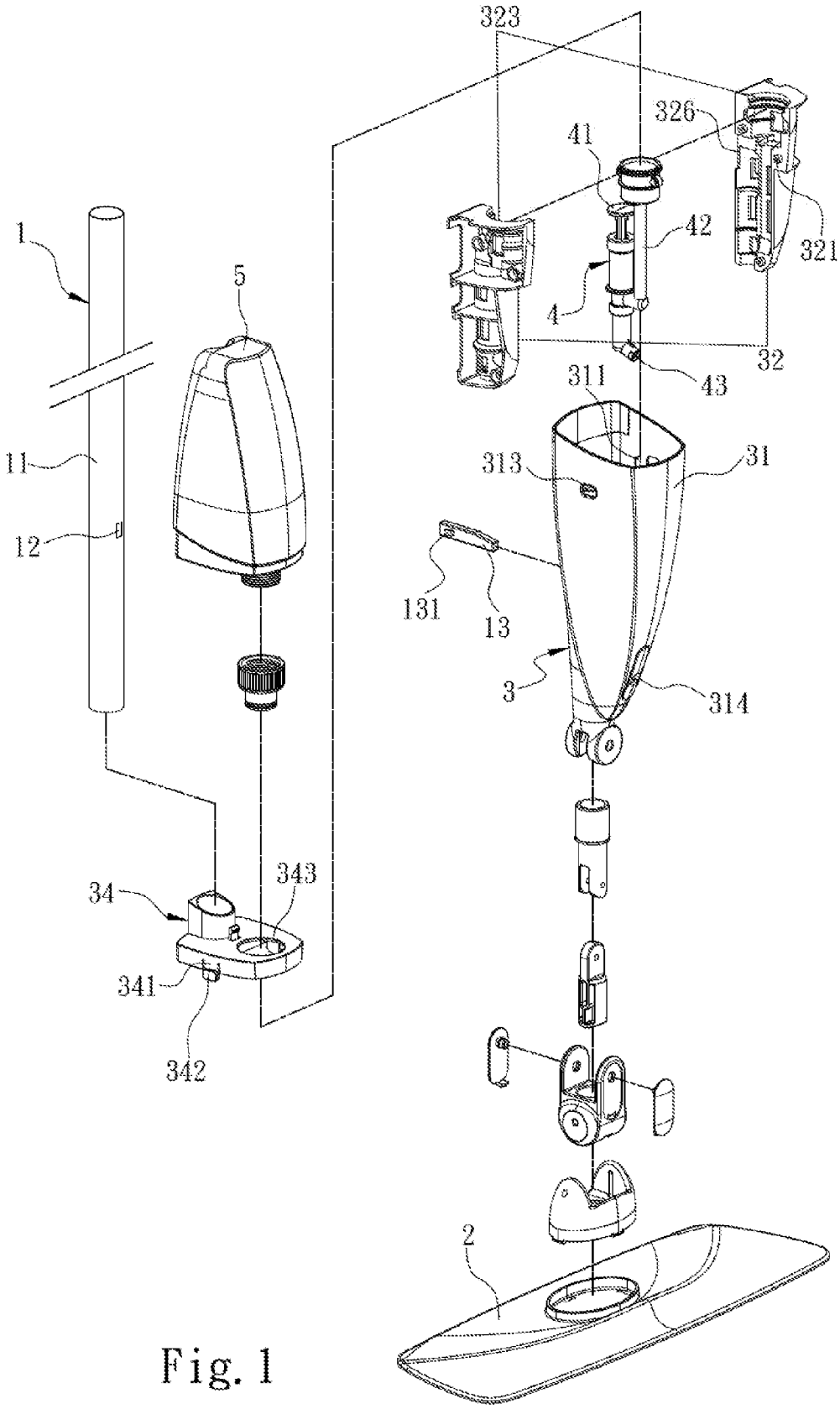
FIG. 1 is an exploded structural view according to an embodiment of the present invention.
Figure 2:
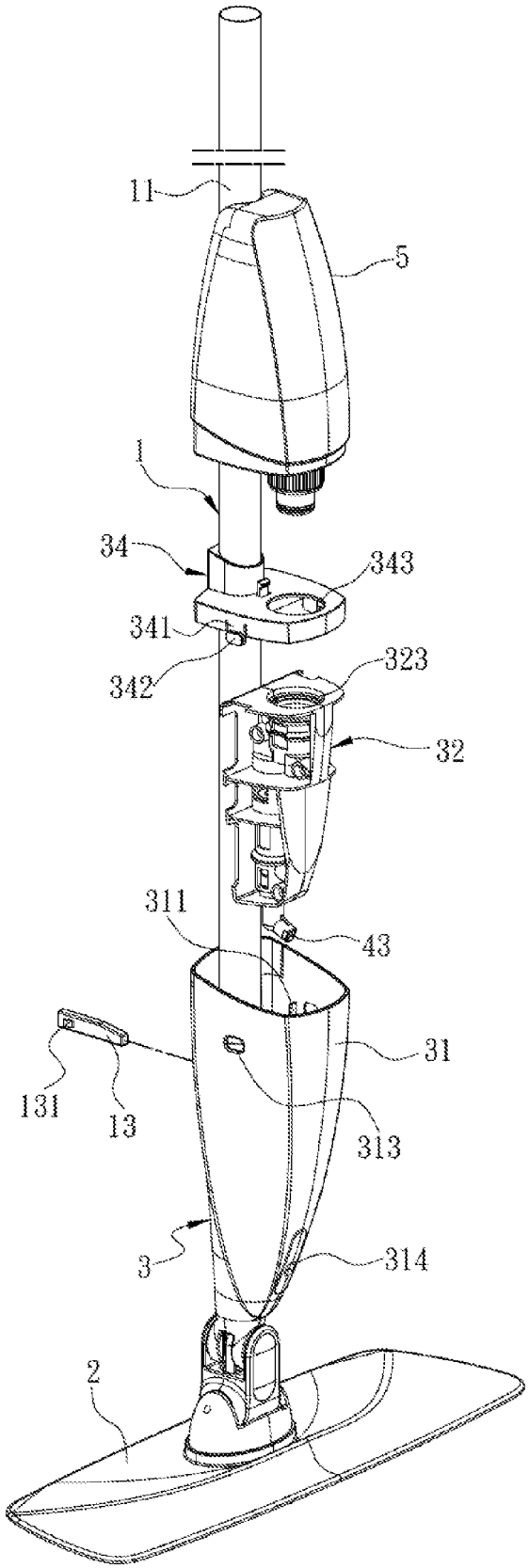
FIG. 2 is a first partial exploded structural view according to an embodiment of the present invention.
Figure 3:
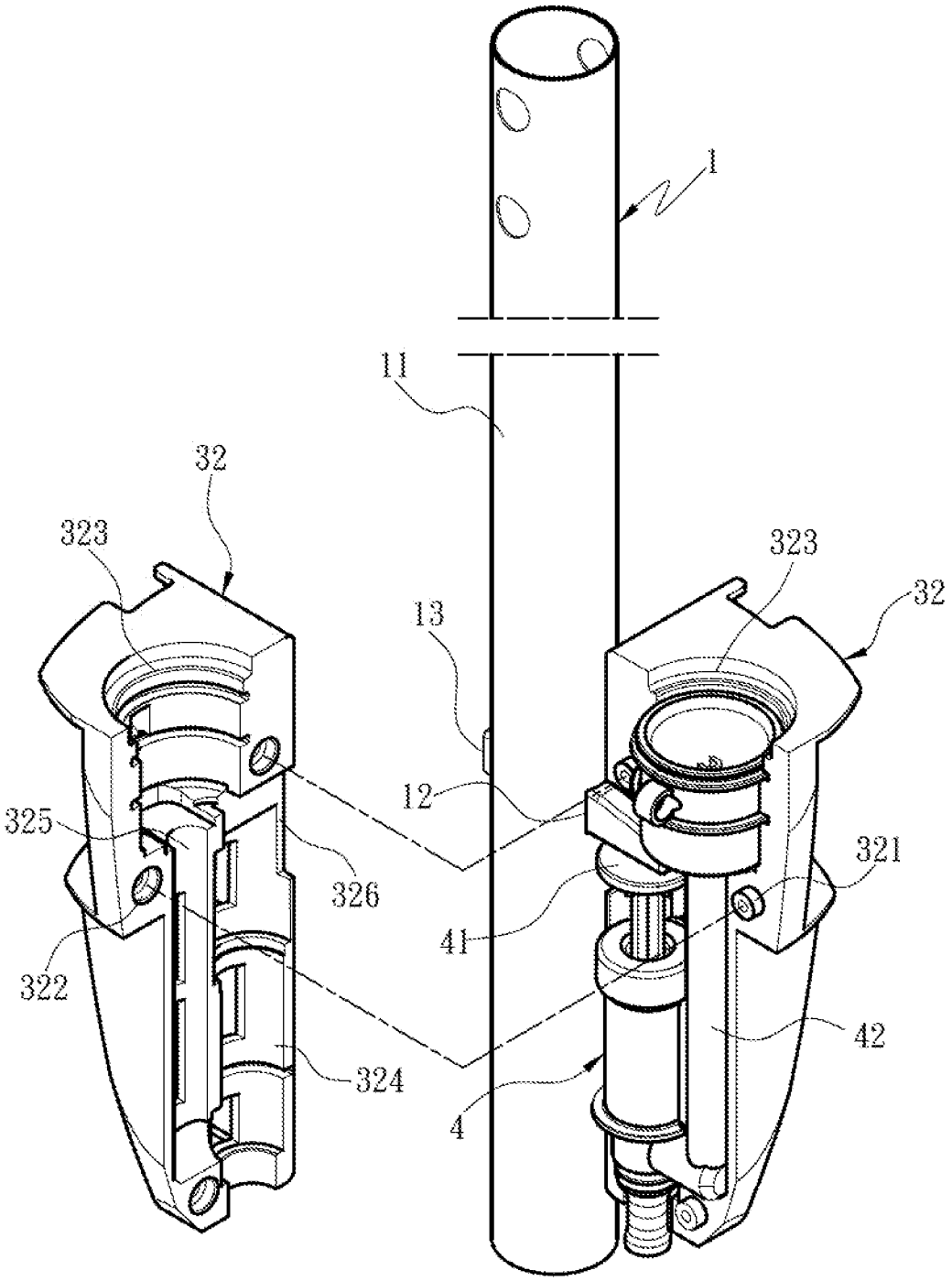
FIG. 3 is an exploded view of support half casings and a spray mechanism according to an embodiment of the present invention.
Figure 4:
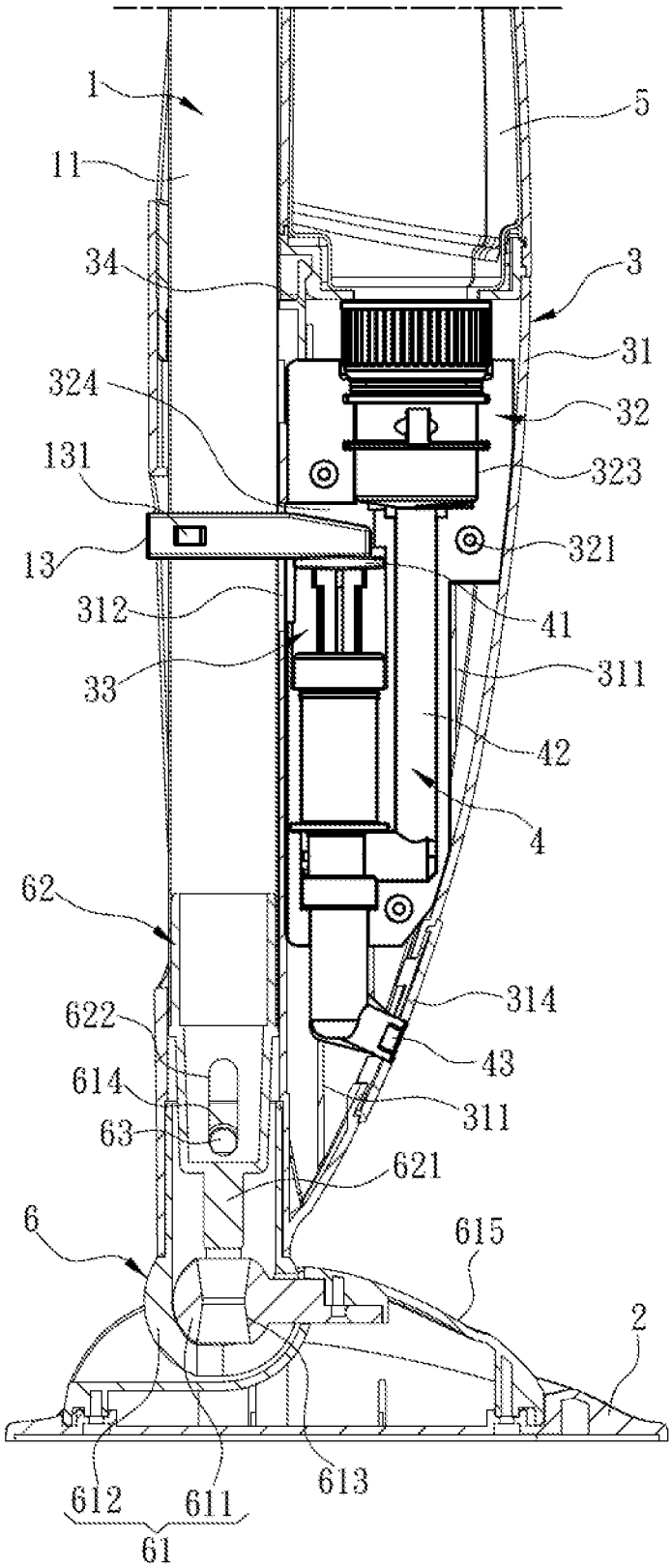
FIG. 4 is a partial sectional view of a non-pressed mop rod according to an embodiment of the present invention.

Referring to FIG. 1 to FIG. 3, the present invention provides a pressing spray mop. The pressing spray mop includes a mop rod 1, a mop head 2 disposed at one end of the mop rod 1, a water tank seat 3 disposed on the mop rod 1, a spray mechanism 4 installed at the water tank seat 3, and a water tank 5 installed on the water tank seat 3 and storing a cleaning liquid. The spray mechanism 4 includes a water drawing member 41, a connecting tube assembly 42 connected to the water drawing member 41 and the water tank 5, and a spray member 43 connected to the water drawing member 41. The water tank seat 3 includes a hollow housing 31 and two support half casings 32. The hollow housing 31 includes a plurality of installation ribs 311 each abutting against at least one of the support half casings 32. The installation ribs 311 are arranged at an interval in the hollow housing 31. The position and the form of appearance of each of the installation ribs 311 arranged in the hollow housing 31 are adjusted according to the shape of the support half casings 32, so as to substantially limit or securely support each of the support half casings 32 in the hollow housing 31. Further, one of the two support half casings 32 includes at least one tenon 321 facing the other support half casing 32, and the other of the two support half casings 32 not provided with the tenon 321 includes at least one mortise 322 corresponding to each tenon 321. Thus, the two support half casings 32 can be joggled with each other using the tenon 321 and the mortise 322 without involving external components (e.g., screw fastening elements or riveting elements) for assembly. Further, each of the support half casings 32 includes an accommodating chamber 323 for accommodating the spray mechanism 4. The appearance of each of the accommodating chambers 323 corresponds to the shape of the spray mechanism 4 to securely accommodate the spray mechanism 4 therein. Further, each of the accommodating chambers 323 includes at least one first accommodating portion 324 for disposing the water drawing member 41, and a second accommodating portion 325 for disposing the connecting tube assembly 42. In one embodiment, the two accommodating chambers 323 may be symmetrical structures. In the installation process of the present invention, the spray mechanism 4 is placed in the accommodating chamber 323 of one of the support half casings 32, and the accommodating chamber 323 of the other support half casing 32 is correspondingly disposed with the spray mechanism 4. Thus, the two support half casings 32 are joggled and joined, and the spray mechanism 4 is encapsulated in the two support half casings 32, thereby completing the assembly of the two support half casings 32 and the spray mechanism 4. From this point, the spray mechanism 4 is supported by the two support half casings 32. Further, each of the support half casings 32 includes a recessed portion 326 connected to the accommodating chamber 323. The two recessed portions 326 form a movement space 33 when the two support half casings 32 are joggled. Further, the two recessed portions 326 are connected to the first accommodating portion 324 and are disposed correspondingly to the water drawing member 41 of the spray mechanism 4, and thus the movement space 33 formed also corresponds to the water drawing member 41. Further, the hollow housing 31 includes a spray opening 314 disposed correspondingly to a spray member 43 of the spray mechanism 4.

Referring to FIG. 1 to FIG. 5, the hollow housing 31 include a through connecting hole 312 disposed correspondingly to the movement space 33. The mop rod 1 includes a rod body 11 to be accommodated by the water tank seat 3, a penetration opening 12 disposed on the rod body 11, and a pressing pin 13 provided at the penetration opening 12 and extended into the movement space 33 via the through connecting hole 312. Further, when the water tank seat 3 is accommodated around the rod body 11 by the hollow housing 31, the penetration opening 12 corresponds to and is in communication with the through connecting hole 312. Next, the pressing pin 13 may sequentially insert into the penetration opening 12 and the through connecting hole 312 to enter the movement space 33. Thus, due to the effect of the pressing pin 13, the water tank seat 3 becomes inseparable from the mop rod 1. In addition, the pressing pin 13 simultaneously limits the movements of the hollow housing 31 and the two support half casings 32, thereby completing the assembly of the water tank seat 3 and the mop rod 1. Thus, without involving external components, the assembly of the water tank seat 3 and the mop rod 1 can be achieved without involving external components, hence omitting the assembly process that uses external components. Further, the stability of the assembled water tank seat 3 and mop rod 1 is substantial to the stability of an assembly achieved with external components. Again referring to FIG. 1 to FIG. 5, in the present invention, the pressing pin 13 is inserted into the rod body 11, and is driven by the rod body 11 as the rod body 11 moves. When the rod body 11 is pressed downwards towards the direction of the mop head 2 by a user operation, the pressing pin 13 linearly moves in the movement space 33 and presses the water drawing member 41 to cause the spray mechanism 4 to perform spraying. At the beginning of water spray performed by the spray mechanism 4, the spray mechanism 4 draws a cleaning liquid in the water tank 5, and sprays the cleaning liquid from the spray opening 314 via the spray member 43. When the user later stops the force that presses the mop rod 1 downwards, the a restoration spring disposed correspondingly to the water drawing member 41 in the spray mechanism 4 pushes the water drawing member 41 up to an original position. During the restoration process of the water drawing member 41, the water drawing member 41 simultaneously pushes up the pressing pin 13 to drive the mop rod 1 to restore an non-pressed form. In one embodiment, the rod body 11 of the mop rod 1 is further a hollow rod body 11, the pressing pin 13 includes at least one inverted hook 131. The inverted hook 131 protrudes from a surface of the pressing pin 13, and limits and prohibits the pressing pin 13 from disengaging from the mop rod 1 after the pressing pin 13 is installed at the rod body 11.

Again referring to FIG. 1 to FIG. 5, in one embodiment, the water tank seat 3 includes a sealing cover 34. The sealing cover 34 is installed in the hollow housing 31 to limit the two support half casings 32. More specifically, the sealing cover 34 is disposed at one side of the water tank seat 3 assembled with the water tank 5, and is then assembled with the hollow housing 31 to seal the two support half casings 32 after the hollow housing 31 and the two support half casings 32 are assembled. The sealing cover 34 includes at least one connecting piece 341 disposed at an edge and along an inner wall of the hollow housing 31. Each of the connecting pieces 341 includes a fastening stopping portion 342 protruding towards a direction of the hollow housing 31. The hollow housing 31 includes at least one limiting hole 313 that forms a fastening relationship with the fastening stopping portion 342. When the fastening stopping portion 342 falls in the limiting hole 313 during the assembly process of the sealing cover 34, the limiting hole 313 and the fastening stopping portion 342 produce a fastening relationship, such that the sealing cover 34 becomes inseparable from the hollow housing 31. Further, the sealing cover 34 includes a through hole 343 disposed correspondingly to the spray mechanism 4. The through hole 343 allows the water tank 5 to penetrate therein to be connected to the spray mechanism 4.

Figure 5:
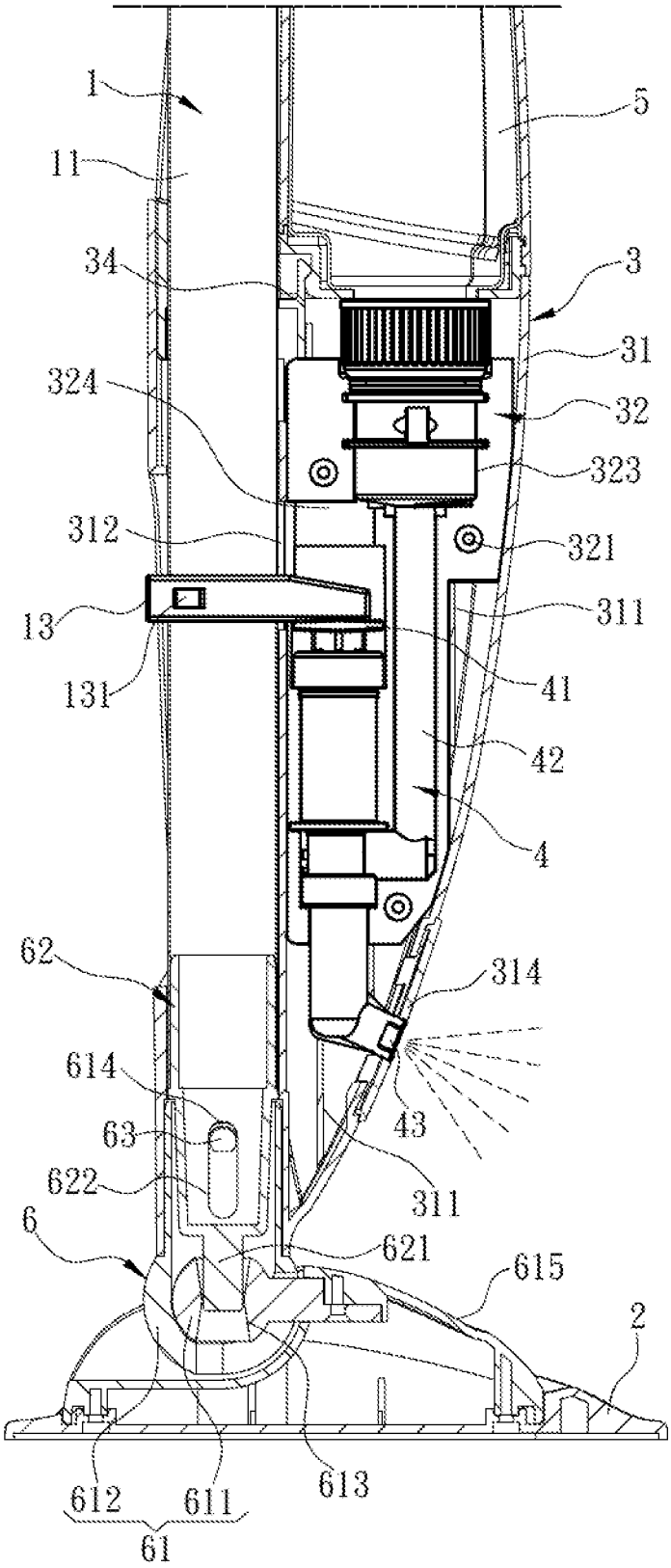
FIG. 5 is a partial sectional view of a mop rod pressed downwards according to an embodiment of the present invention.
Figure 6:
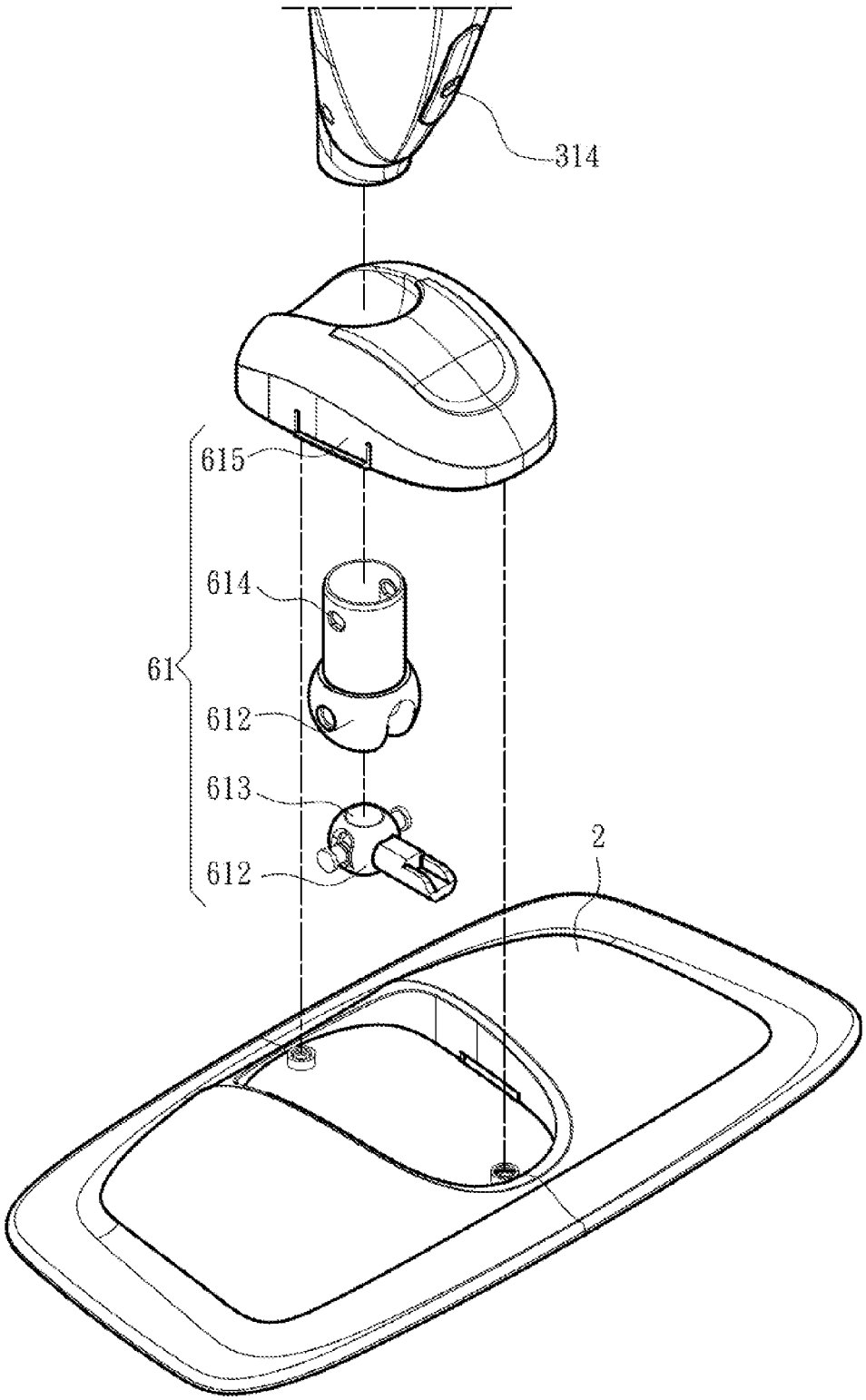
FIG. 6 is a second partial exploded structural view according to an embodiment of the present invention.
Figure 7:
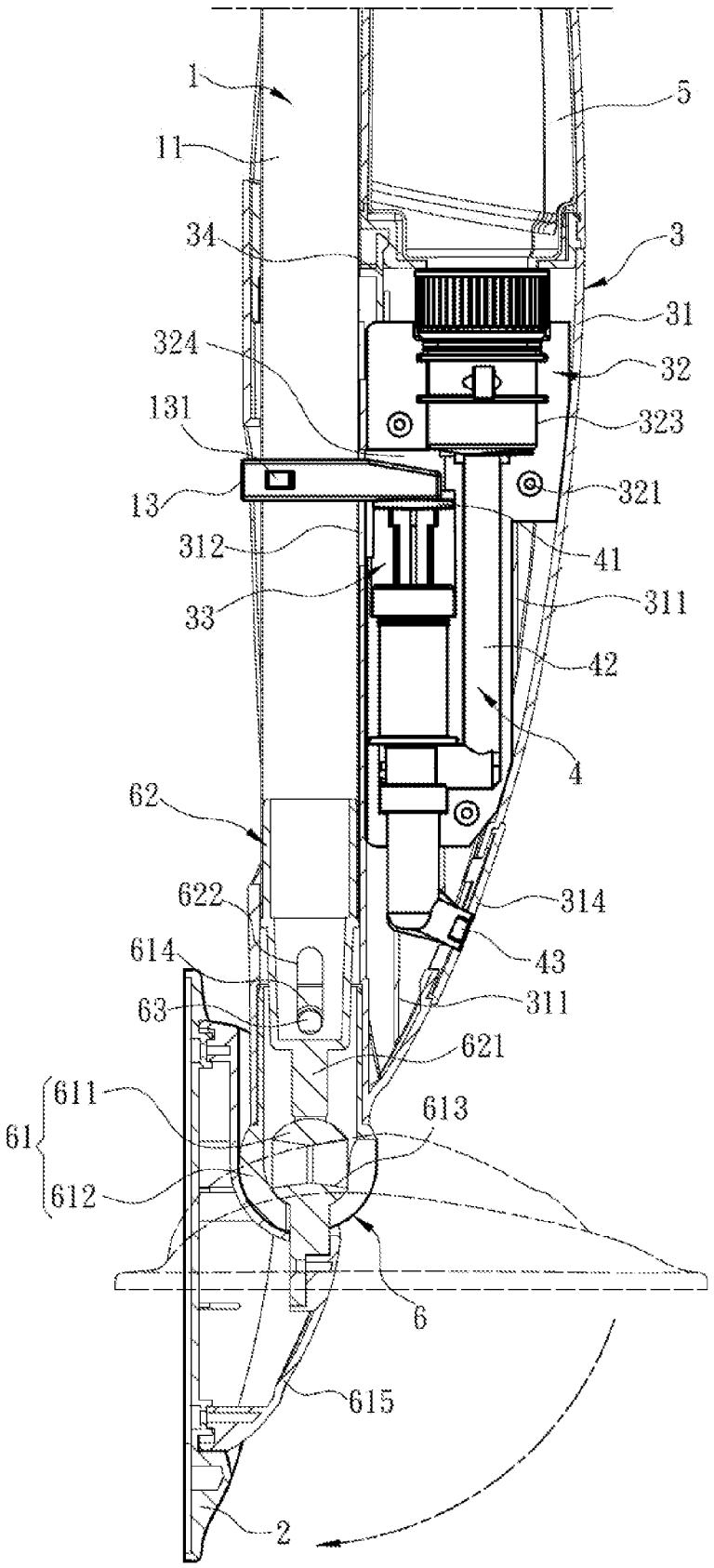
FIG. 7 is a schematic diagram of a locked state of a pressing spray mop according to an embodiment of the present invention.

Referring to FIG. 6 and FIG. 7, in one embodiment, the pressing spray mop of the present invention includes a mobile connecting mechanism 6 connected to the mop rod 1 and the mop head 2. The mobile connecting mechanism 6 has a locked state and a utilization state. In the locked state, the mop rod 1 is placed levelly on the mop head 2 to prohibit the mop rod 1 from being pressed downwards. In the utilization state, the mop rod 1 is at an inclined angle relative to the mop head 2 to allow the mop rod 1 to be pressed downwards. In one embodiment, the inclined angle is 90 degrees. Further, in the present invention, in addition to the function of assembling the mop rod 1 and the mop head 2, the mobile connecting mechanism 6 further provides a function of limiting and prohibiting the pressing spray mop from performing water spray. The mobile connecting mechanism 6 includes a connecting seat 61 disposed on the mop head 2, a connecting member 62 disposed on the mop rod 1, and an inserting member 63. The connecting seat 61 includes a connecting pole 611, and a connecting sleeve 612 assembled on the connecting pole 611 and capable of rotating multi-directionally. The part of the connecting pole 611 installed in the connecting sleeve 612 includes a penetration hole 613 formed at the inclined angle. On the other hand, the connecting sleeve 612 includes two correspondingly disposed installation holes 614. The connecting member 62 includes a trigger head portion 621 facing the connecting pole 611 and a hollow portion 622. The appearance of the trigger head portion 621 is formed correspondingly to the form of the penetration hole 613 to allow the trigger head portion 621 to move in the penetration hole 613. The hollow portion 622 penetrates the connecting member 62 and may be a long hole. Further, in the installation process of the embodiment, the inserting member 63 passes through one of the installation holes 614 and the hollow portion 622 to be disposed on the other installation hole 614. In other words, the inserting member 63 of the present invention fixedly connects the two installation holes 614 and penetrates the hollow portion 622. As such, the connecting sleeve 612 is assembled with the connecting member 62. Further, with such design of the hollow portion 622, the inserting member 63 is allowed to linearly move in the hollow portion 622 according to the application of the mop rod 1. The connecting seat 61 further includes base 615 for disposing the connecting pole 611, and the base 615 is further disposed on the mop head 2. Referring to FIG. 5 and FIG. 7, when the mop rod 1 is operated by the user and has an inclined angle relative to the mop head 2, the mobile connecting mechanism 6 is in the utilization state. When the mop rod 1 is pressed downwards by a force received, the inserting member 63 is capable of linearly moving in the hollow portion 622. Thus, the trigger head portion 621 of the connecting member 62 is allowed to extend into the penetration hole 613 to allow the mop rod 1 to be pressed downwards to perform spraying. On the other hand, when the mop rod 1 is operated by the user and placed levelly on the mop head 2, the mobile connecting mechanism 6 is in the locked state, and the trigger head potion 621 of the connecting member 62 is abutted against the connecting pole 611 to prohibit the mop rod 1 from being pressed downwards.

What is claimed is:

1. A pressing spray mop, comprising a mop rod, a mop head disposed at one end of the mop rod, a water tank seat disposed on the mop rod, a spray mechanism installed at the water tank seat, and a water tank installed at the water tank seat and storing a cleaning liquid; the spray mechanism comprising a water drawing member, a connecting tube assembly connected to the water drawing member and the water tank, and a spray member connected to the water drawing member; the pressing spray mop being characterized that:

the water tank seat comprises a hollow housing, and two support half casings accommodated in the hollow housing after having been joggled with each other, the two assembled support half casings forming a movement space for disposing the water drawing member of the spray mechanism; the hollow housing comprises a through connecting hole disposed correspondingly to the movement space; the mop rod comprises a rod body to be accommodated by the water tank seat, a penetration opening disposed on the rod body, and a pressing pin provided at the penetration opening and extended into the movement space via the through connecting hole; the pressing pin is driven and displaced by the mop rod in the movement space and presses the water drawing member to cause the spray mechanism to perform spraying.

2. The pressing spray mop of claim 1, being characterized that, one of the two support half casings comprises a tenon facing the other support half casing, and the other of the two support half casing not provided with the tenon comprises at least one mortise corresponding to each tenon.

3. The pressing spray mop of claim 1, being characterized that, each of the support half casings comprises an accommodating chamber for accommodating the spray mechanism, and each of the accommodating chambers comprises a first accommodating portion for disposing the water drawing member and a second accommodating portion for disposing the connecting tube assembly.

4. The pressing spray mop of claim 3, being characterized that, each of the support half casings comprises a recessed portion connected to the accommodating chamber, and the two recessed portions form the movement space after the two support half casings are joggled.

5. The pressing spray mop of claim 4, being characterized that, the pressing pin comprises at least one inverted hook, which limits and prohibits the pressing pin from disengaging from the mop rod.

6. The pressing spray mop of claim 1, being characterized that, the hollow housing comprises a plurality of installation ribs each abutting against at least one of the support half casings.

7. The pressing spray mop of claim 1, being characterized that, the water tank seat comprises a sealing cover installed at the hollow housing to limit the two support half casings.

8. The pressing spray mop of claim 6, being characterized that, the sealing cover comprises at least one connecting piece disposed along an inner wall of the hollow housing; each of the connecting pieces comprises a fastening stopping portion protruding towards a direction of the hollow housing; and the hollow housing comprises at least one limiting hole that forms a fastening relationship with the fastening stopping portion.

9. The pressing spray mop of claim 1, being characterized that, the pressing spray mop comprises a mobile connecting mechanism connected to the mop rod and the mop head; the mobile connecting mechanism has a locked state and a utilization state; in the locked state, the mop rod is placed levelly on the mop head to prohibit the mop rod from being pressed downwards, and in the utilization state, the mop head displays an inclined angle to allow the mop rod to be pressed downwards.

10. The pressing spray mop of claim 9, being characterized that, the inclined angle is 90 degrees.

11. The pressing spray mop of claim 9, being characterized that, the mobile connecting mechanism comprises a connecting seat disposed on the mop head, a connecting member disposed on the mop rod, and an inserting member; the connecting seat comprises a connecting pole formed with a penetration hole formed at the inclined angle, and a connecting sleeve assembled on the connecting pole and capable of rotating multi-directionally; the connecting sleeve comprises two correspondingly disposed installation holes; the connecting member comprises a trigger head portion and a hollow portion; the inserting member fixedly connects the two installation holes and penetrates the hollow portion; when the mobile connecting mechanism is in the utilization state, the inserting member is capable of linearly moving in the hollow portion to allow the trigger head portion of the connecting member to extend into the penetration hole to further allow the mop rod to be pressed downwards; when the mobile connecting mechanism is in the locked state, the trigger head portion of the connecting member is abutted against the connecting pole to prohibit the mop rod from being pressed downwards.

* * * * *